United States Patent [19]

Igel

[11] 3,992,864

[45] Nov. 23, 1976

[54] METHOD OF AND APPARATUS FOR AUTOMATIC REATTACHMENT OF THREADS IN SPINNING MACHINES

[75] Inventor: Wolfgang Igel, Ebersbach, Germany

[73] Assignee: Zinser Textilmaschinen GmbH, Ebersbach, Germany

[22] Filed: Oct. 9, 1974

[21] Appl. No.: 513,305

[30] Foreign Application Priority Data

Oct. 12, 1973 Germany ..... 2351312

[52] U.S. Cl. ..... 57/34 R; 57/156

[51] Int. Cl.[2] ..... D01H 15/00

[58] Field of Search ..... 57/34 R, 52–54, 57/156, 75

[56] References Cited

UNITED STATES PATENTS

| | | | |
|---|---|---|---|
| 3,540,200 | 11/1970 | Tsukumo et al. | 57/34 R |
| 3,591,951 | 7/1971 | Urano et al. | 57/34 R |
| 3,640,059 | 2/1972 | Lutovsky et al. | 57/34 R |
| 3,807,155 | 4/1974 | Miyazaki et al. | 57/34 R |

*Primary Examiner*—John Petrakes
*Attorney, Agent, or Firm*—Edwin E. Greigg

[57] ABSTRACT

A method for the automatic repair of thread breakage in spinning machines includes the steps of searching for an end of a broken thread on a take-up thread holder. The method involves grasping the end of the thread, if found, pulling the thus grasped thread into a traveler and a thread guide and combining the thus pulled thread with roving emerging from delivery rollers. In the method it is determined if repair of thread breakage is not possible by the series of steps set out above, and then an auxiliary thread is supplied from an auxiliary thread supply and fastened on the thread holder. Subsequently, the auxiliary thread is detached from its supply thereby providing a new thread end on the thread holder, and thereafter the searching, grasping, pulling and combining steps of the method are performed. An apparatus is provided for carrying out the method.

10 Claims, 9 Drawing Figures

METHOD OF AND APPARATUS FOR AUTOMATIC REATTACHMENT OF THREADS IN SPINNING MACHINES

BACKGROUND OF THE INVENTION

This invention relates to a method of automatically reattaching broken threads in spinning machines, as well as to an apparatus for performing this method.

Known thread attachment apparatus, such as the apparatus disclosed in U.S. Pat. No. 3,807,155 operates so that, in imitation of the manual techniques used by operators of spinning wheels and the like, the end of the broken thread is searched for on the bobbin or the spool and is grasped so as to be used in the actual attachment step of the method. This search for the end of the thread is a critical part of the entire thread breakage repair routine, because finding this thread end is difficult and often fails. If the end of the thread cannot be found, either because it cannot be loosened from the winding, or else because there is no thread present on the spool after a spool change, then the thread breakage cannot be repaired.

In order to avoid the above-mentioned disadvantage, it is provided in other known thread attachment apparatus, such as the apparatus disclosed in U.S. Pat. No. 3,591,951, that the end of the thread is not searched for on the bobbin or spool, but rather that another thread, a so-called auxiliary thread, is taken from a supply, carried by the attachment apparatus, and is "thrown" on the bobbin or spool, i. e., its end is wound up on the bobbin or spool. This thread can be grasped by the attachment apparatus and can be separated at a place between the thread arrester and the thread supply, i. e., it can be separated from the thread supply. The end of the thread thus obtained is then attached in the usual manner, i. e., after it is pulled into the traveler and the thread guide, it is joined to the roving sliver emerging from the delivery rollers. This technique has the disadvantage, however, that there is no connection between the broken thread and the reattached thread. When the thread is unwound in a subsequent operation, this becomes manifest as a thread breakage, i. e., at another machine.

SUMMARY OF THE INVENTION

An object of the present invention is to provide a method of automatically reattaching broken threads in a spinning machine which is free, as far as possible, of the disadvantage of a failure of the attachment of the thread due to not finding the end of the thread on the bobbin or spool, as well as the disadvantage of a missing connection between the thread.

It is another object of the present invention to provide an apparatus for automatic repair of thread breakage which is free, to the greatest possible extent, of the disadvantage of a failing to attach due to not finding the end of the thread and the disadvantage of missing a connection between the thread.

For this purpose, the present invention proposes that the attachment apparatus be provided with devices for performing the attachment step and primarily to attempt to carry out the attachment by firstly searching for an end of the torn thread on the bobbin or spool and effecting the reattachment by means of the torn end of the thread. Only if this technique fails, then, according to a second described technique, an auxiliary thread is "thrown" on the bobbin or spool, i. e., its end is wound around the bobbin or spool and the thread attachment is made to this auxiliary thread. This achieves that, at least, the repair of thread breakage does not fail because the end of the thread cannot be found on the spool and that a discontinuity of the woundup thread on the spool will be present only if the thread breakage could not have been repaired in any other way.

The method of the present invention requires a decision which of the two attachment tehniques should be carried out. That can be done, according to the present invention, in that, at first, the first-mentioned attachment routine is initiated and the broken thread is searched for on the bobbin or spool. If the broken thread is found, this attachment routine is carried out to its conclusion. However, if the thread end search step is without result, i. e., the thread end cannot be found on the bobbin or spool, then the first-mentioned attachment routine is interrupted, and the second-mentioned attachment routine is initiated by literally throwing an auxiliary thread on the bobbin or spool, thereby making it fast, and thereafter by repairing the breakage with the aid of this auxiliary thread.

According to another proposal of the present invention, it is to be firstly determined whether a winding (yarn package) or a partial winding is already present on the bobbin or spool. This is done because only if the winding is already present does it make sense to initiate a searching step for the end of the broken thread, and thus, this searching step is only initiated when a thread winding is actually present on the spool. If a thread winding is not present, then the second-mentioned reattachment routine is immediately initiated by placing an auxiliary thread on the bobbin or spool.

The known thread attachment apparatuses, which operate by throwing an auxiliary thread onto the spool, do not have any mechanism for searching for the broken end of the thread, because they grasp the auxiliary thread running onto the bobbin or spool and separate it from the thread supply and perform the reattachment with the aid of this grasped and separated thread end. An apparatus according to the present invention, would have to have, therefore, either a thread-holding mechanism which could hold the end of the thread found on the bobbin or spool as well as the end of the thread formed by separation of the auxiliary thread. Alternatively, the prior art apparatuses would have to have a transfer mechanism which would transfer the end of the thread found on the bobbin or spool and held by a first holding device together with the end of the thread formed by separation of the auxiliary thread and held by a second holding device to a third holding device which treats both thread ends, which were created in different ways, in the same manner.

To avoid this multiplicity of holding devices, the present invention further proposes that the thread end which is produced by separating the auxiliary thread from the thread supply from which it comes is not held fast and connected immediately to the roving emerging from the delivery rollers, but rather it is permitted to run up on the bobbin or spool and, subsequently, the first-mentioned attachment routine is carried out, this routine including the steps of searching, grasping, etc., of the thread end on the bobbin or spool. This has the advantage that the thread attachment apparatus, according to the present invention only needs devices for effecting the first-mentioned attachment routine. This attachment routine can be carried out in the same way, including all of the steps, and for all cases of thread breakage. Depending on whether the end of a broken thread is or is not found on a bobbin or spool at which a thread breakage is to be repaired, according to the present invention, this first-mentioned reattachment rountine either is immediately initiated and carried out in all of its steps, or else, prior to it, the auxiliary thread is thrown onto the spool and only thereafter is this first-mentioned reattachment routine initiated and carried out in all of its steps. It is to be understood that a reattachment routine, once initiated, need not be carried out in all of its steps if the search step is without a result in spite of the fact that a winding is present on the bobbin or spool. In that case, the attachment routine, including the searching step can be terminated and the throwing of the auxiliary thread onto the bobbin or spool may be initiated.

The separated, blunt end of the auxiliary thread is almost always easily found, in contrast to the end of the broken thread which often terminates in individual, small fibers. If, however, this should not be the case, then the attachment routine may again be interrupted after the fruitless search and the cycle could be repeated by throwing a new auxiliary thread end onto the bobbin or spool and the first-mentioned reattachment routine thereafter initiated.

Further advantages of the present invention will be recognized in the subsequent description, considered in connection with the drawing.

BRIEF DESCRIPTION OF THE DRAWING

For better comprehension, the same reference letters and numerals are used for identical parts in the several figures.

DESCRIPTION OF THE PREFERRED EMBODIMENTS

Figure 1:
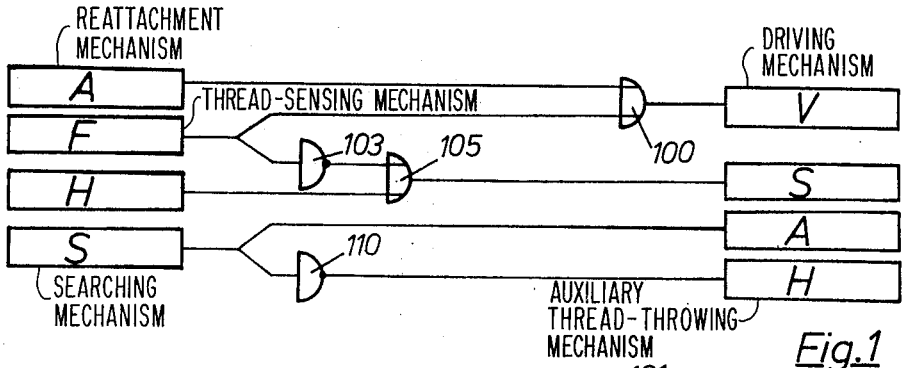
FIG. 1 is a schematic representation of a first exemplary form of an apparatus for the automatic repair of thread breakage in spinning machines, according to the present invention, the apparatus including a logic circuit arrangement for controlling the thread reattaching routines.

In FIGS. 1–5, The individual assemblies, by means of which and in cooperation whereof the method according to the present invention is carried out, are shown purely schematically in block diagram form. In the schematic diagrams of the circuits of FIGS. 1, 3, and 5, including the logic circuit arrangements, the progress of the pulse signals is from left to right in all cases. The signals fed to the blocks toward the right act as input pulses for activating these assemblies. Signals coming from the blocks shown on the left are output signals from these assemblies after a terminated activity or after the result of a sensing function and they proceed as input signals into the logic circuit arrangement. Those assemblies which both produce and respond to signals are shown, for the sake of clarity on both the left and right, respectively, in FIGS. 1, 3, and 5.

The assemblies referred to hereinafter respectively as a "thread-sensing mechanism," a "searching mechanism," an "attachment mechanism," a "drive mechanism" and an "auxiliary thread-throwing mechanism" may be of known construction and may be embodied as disclosed in the initially cited U.S. patents or in other generally known printed publications. Thus, a detailed description of these known assemblies in all details is unnecessary here.

The thread-sensing mechanism F may advantageously consist of a conventional sensor, such as a finger, which can be placed in contact with thread coming from a pair of delivery rollers and going to a thread guide of the spinning machine and which senses the presence or absence of the thread. The thread-sensing device may also consist of a light source, which illuminates a thread, and a light-sensitive cell which responds to the light reflected from the thread. In either case, the thread-sensing mechanism generates a signal whenever the thread is absent, the signal being used for initiating a thread attachment routine.

The searching mechanism S comprises a device which searches for the end of the thread on the bobbin or spool (not shown), for example, by means of a suction line, usually a flexible line with a suction nozzle, connected to a source of reduced air pressure. The searching mechanism S in operation, pulls the loose end of the broken thread away from the surface of the winding on the bobbin or spool and also senses whether the thread has been found.

The reattachment mechanism A comprises devices which grasp the found thread, thread it into a traveler arranged on a spinning ring, and into a thread guide and connect it with the roving emerging from the pair of delivery rollers.

The auxilary thread-throwing mechanism H includes a supply of auxiliary thread, as well as a thread transport apparatus which takes an end of this thread supply, throws it onto the bobbin or spool and lets it be wound up there. The auxiliary thread-throwing mechanism H, according to the invention, further includes a thread-separating apparatus, which permits separating the thread thrown onto the bobbin or spool and wound up on the bobbin or spool. The thread-separating apparatus is to be described in more detail below.

A conventional driving mechanism includes a drive motor which moves an attachment carriage carrying the thread-sensing mechanism F, the searching mechanism S, the reattachment mechanism A, and the thread-throwing mechanism H along a row of spindles, and further includes a mechanism for switching this motor on and off and an arrest mechanism which stops the attachment carriage precisely in the respective correct positions for carrying out an attachment routine and holds it there.

Figure 2:
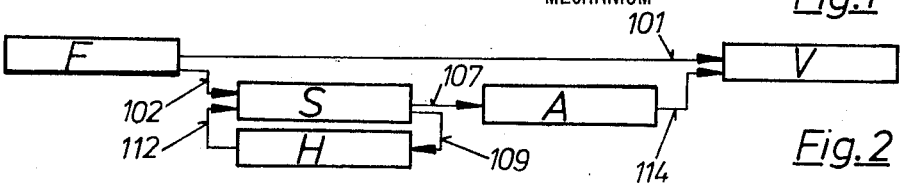
FIG. 2 is a simplified block wiring diagram of the thread reattachment apparatus shown in the circuit diagram of FIG. 1, the logic circuit components of FIG. 1 not being visible.

The operation of an exemplary apparatus for effecting the automatic repair of thread breakage, which includes the above-mentioned assemblies, is now to be described with the aid of FIGS. 1 and 2. The attachment carriage, in which the above-mentioned assemblies are installed, moves along the row of spindles of the spinning machine. While doing so, the thread-sensing mechanism F tests the positions in front of the individual spinning stations for the presence of a thread which should be there and produces an appropriate input pulse to the logic circuit control arrangement. If the thread is present, then the positive pulse (ONE signal) is fed, via line 101, to the driving mechanism V to cause a movement of the thread attachment carriage to a position in front of the next spinning station. This pulse is transmitted through the line 101 (FIG. 2) via an OR gate 100 (FIG. 1) of the logic circuit arrangement. If the thread is not present, i. e., if a thread breakage has occurred, then a pulse (ONE signal) is produced by a NOT circuit 103 (FIG. 1) and transmitted through line 102 (FIG. 2) via an OR gate 105 (FIG. 1) to the searching mechanism S activating this searching mechanism. The searching mechanism S terminates its activity if it finds the thread or, if it has not found the thread after an appropriate predetermined searching time has elapsed, it produces an appropriate input pulse (ONE signal) for the logic circuit arrangement. If the thread has been found, then a pulse (ONE signal) produced thereby is transmitted, via a line 107 (FIG. 2) to the attachment mechanism A, which initiates an attachment routine. If no pulse is received from the searching mechanism, then a pulse (ONE signal) produced by a NOT circuit 110 is transmitted, via a line 109 (FIG. 2) to the auxiliary attachment mechanism H which throws an auxiliary thread onto the bobbin or spool. After the auxiliary thread has been thrown onto the bobbin or spool, this attachment mechanism H delivers an input pulse to the logic circuit arrangement which is transmitted, via a line 112 (FIG. 2) and through the OR gate 105 as a switching signal for the searching mechanism S. The searching mechanism S repeats the above-described cycle. It should be noted that a counter or the like, desirably, should be provided which limits the number of sequential searches and auxiliary thread-throwing steps and which, when reaching a suitable maximum number, delivers a pulse (ONE signal) to the driving mechanism because, in that case, the thread breakage cannot be considered to be capable of automatic repair. Consequently, the attachment carriage is allowed to travel on to the next spinning station once the attachment mechanism A has attached a thread, it delivers an input pulse signal (ONE signal) to the logic circuit arrangement which is transmitted as a turn-on signal for the driving mechanism V through a line 114 (FIG. 2) and the OR gate 100.

In the above-described apparatus, a search routine for the end of the broken thread is always initiated when a thread breakage is determined. Of course, this search process is always condemned to failure in advance and is therefore superfluous, if there is no thread winding on the bobbin or spool, possibly due to recent bobbin or spool change.

Figure 3:
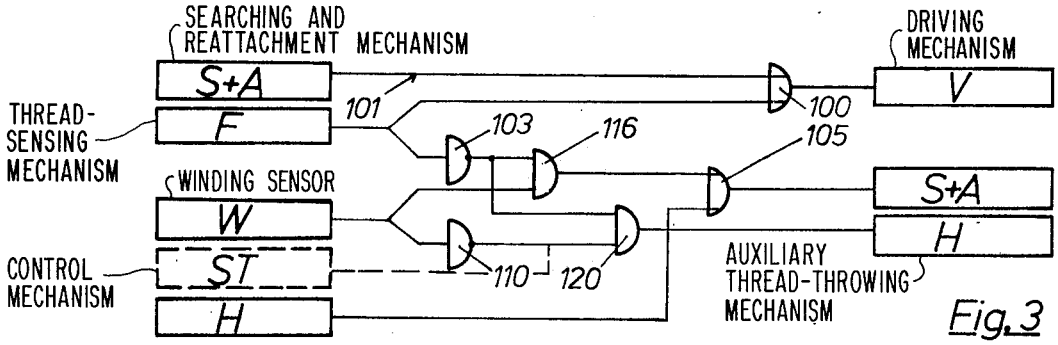
FIG. 3 is a schematic representation of an exemplary form of an apparatus for automatic repair of thread breakage in spinning machines similar to that of FIG. 1, but somewhat more complex, its logic circuit arrangement being shown in detail.
Figure 4:
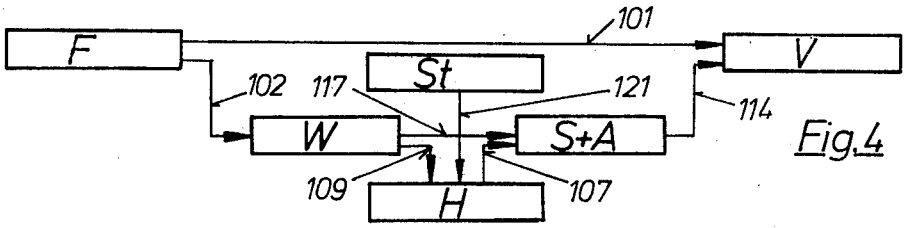
FIG. 4 is a simplified block wiring diagram of the assemblies of the attachment apparatus according to FIG. 3, the logic circuit components of FIG. 3 not being visible.

Thus, FIGS. 3 and 4 show a similar, but more complex, embodiment of an apparatus for the automatic repair of thread breakage than that of FIGS. 1 and 2. In FIGS. 3 and 4, the apparatus has been supplemented by a winding sensor W, i. e., a sensing mechanism W to test for the presence or absence of a thread winding on the bobbin or spool. The winding sensor W can be embodied in similar fashion as the thread-sensing mechanism F, its purpose being to determine whether a thread winding is present on the bobbin or spool or is not present on the bobbin or spool. The thread-winding sensor W may include a source of light, whose beam is directed to the thread winding on the spinning bobbin or spool, and light-sensitive cell which responds to light reflected by the thread winding, this winding sensor producing a pulse (ONE signal) whenever it senses the presence of a winding on the bobbin or spool.

For clarity, the search mechanism S and attachment mechanism A are shown combined in FIGS. 3 and 4. It should be understood, however, that the line and logic circuit components of these two assemblies could also be disposed as described above in connection with FIGS. 1 and 2.

In contrast to the operation of the apparatus of FIGS. 1 and 2, the apparatus of FIGS. 3 and 4 functions so that if there is no pulse (ZERO signal) from the thread-sensing mechanism F at the NOT gate 103, then it produces a pulse (ONE signal) which is transmitted, via the OR gate 105, as a switch-on signal for the search and attachment mechanism S plus A only in the case that there is also present, at an AND gate 116, a pulse coming from the winding sensor W. In other words, the winding sensor W takes a pulse (ONE signal) obtained from the line 102 from the thread-sensing mechanism F and conducts it through a line 117 as a switch-on signal for the search and attachment mechanism S plus A but only in case it senses the presence of a thread winding on the particular bobbin or spool being examined. If the winding sensor W does not sense the presence of a thread winding, then it delivers a switch-on signal to the thread-throwing mechanism H through the line 109. As regards the logic circuit, a missing pulse (ZERO signal) from the winding sensor W in the NOT gate 110 generates a pulse (ONE signal) if it is present at the inputs of an AND gate 120 together with the pulse (ONE signal) from the thread-sensing mechanism F coming via the NOT gate 103. This switching pulse (ONE signal) is then delivered to the auxiliary thread-throwing mechanism H.

Immediately after changing spools, practically all thread breakages must be relieved by launching an auxiliary thread, and therefore it is in many cases advantageous to disable the winding sensor W and provide, or to switch on, a control mechanism ST, shown in dashed lines in FIG. 3, which delivers a pulse (ONE signal) through a line 121 (FIG. 4) corresponding to an absent winding, i.e., it simulates an "absent winding" by means which can be made effective by an operator, at his option. The control mechanism ST can be switched on after bobbin or spool change at one spindle side of the spinning machine prior to the first passage of the reattachment carriage, and can then be switched off after this passage.

In many cases, it is either required or advanatageous if the method of operation of the reattachment carriage can be influenced in dependence on the position of the ring rail. For example, it can happen that when there is no thread winding on the bobbin or spool, an auxiliary thread is still launched and, hence, the winding on a bobbin or spool is begun even though the ring rail is no longer in its lowest position or lowest region and, thus, a so-called deformed thread package is made. In order to be able to influence the method of operation of the reattachment carriage in such a case, according to a further embodiment of the invention, there is provided a ring rail sensor R (FIG. 5) which includes a sensor determining the position of the ring rail relative to the spindle, and a signaling member which generates different signals depending on whether the ring rail moves in the lower or upper partial region of its stroke. The limits of these partial regions can be suitably adjustable and are so chosen that a winding on the bobbin or spool, which is begun in the lower portion, is no longer considered a deformed bobbin. The package is thus made uniform as well.

Figure 5:
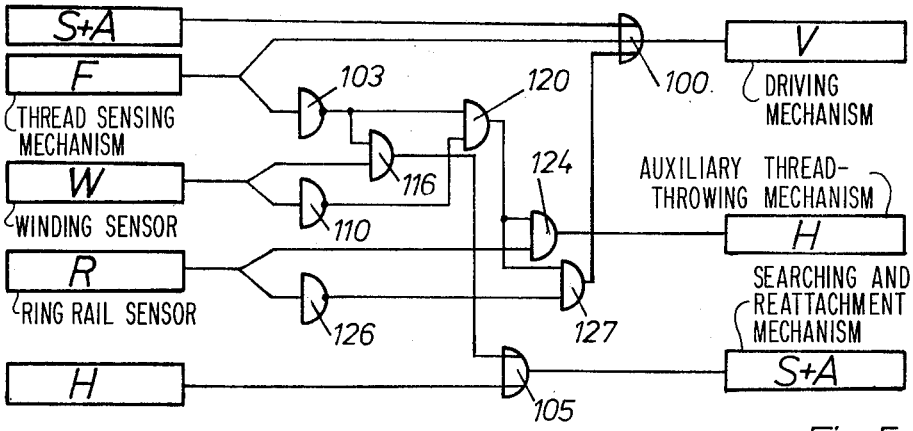
FIG. 5 is a schematic representation of an exemplary form of an apparatus for automatic repair of thread breakage in spinning machines similar to that according to FIGS. 1 and 3, but still somewhat more complex, its logic circuit arrangement being shown in detail.
Figure 7:
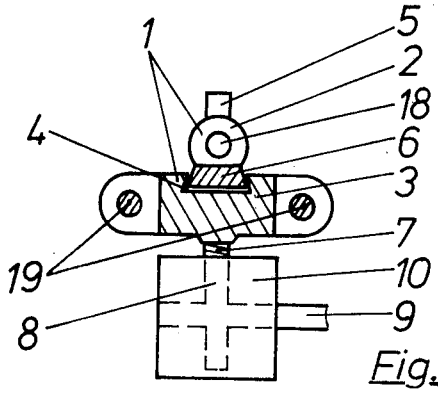
FIG. 7 is a front, partially sectional, elevational view of the thread transport mechanism shown in FIG. 6.
Figure 6:
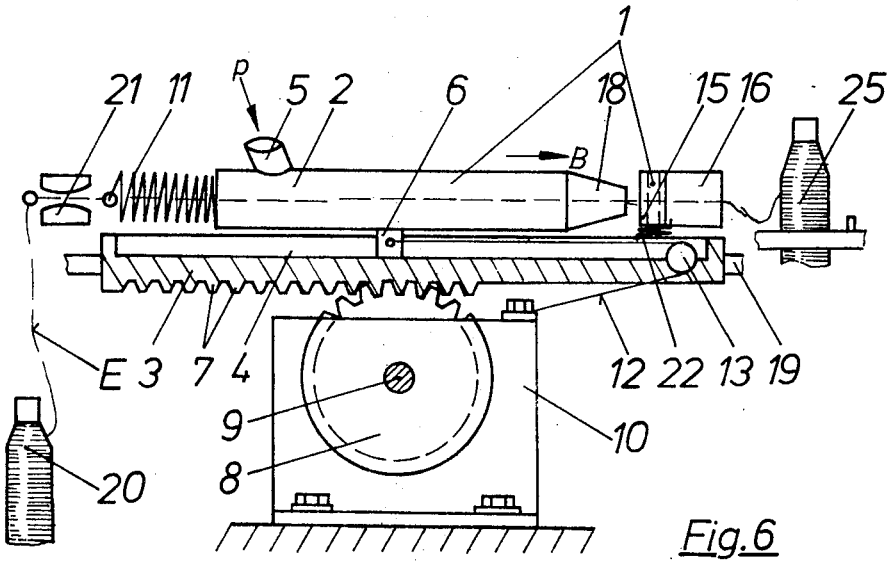
FIG. 6 is a side, partially sectional view of a thread transport mechanism which may be used in an apparatus according to an exemplary embodiment of the present invention for the automatic attachment of threads in spinning machines.
Figure 8:
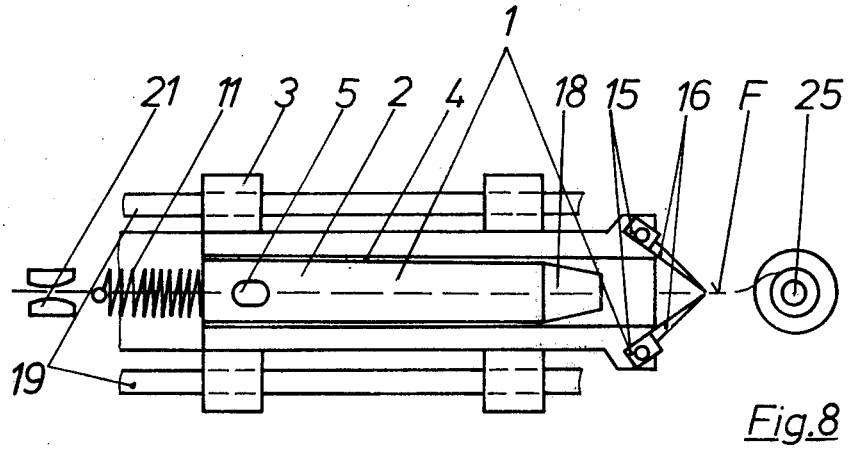
FIG. 8 is a top view of the thread transport mechanism of FIG. 6, the slide and the nozzle being shown in the advanced position.
Figure 9:
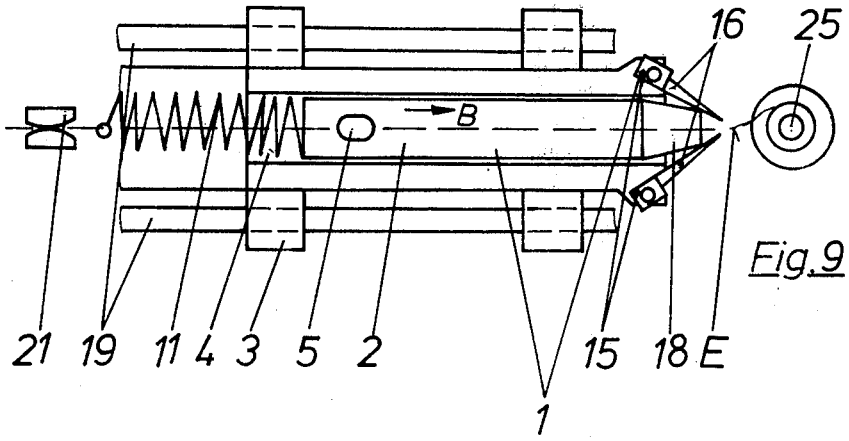
FIG. 9 is a top view of the thread transport mechanism of FIG. 6, the slide and nozzle being shown in the retracted position.

FIG. 5 is a schematic diagram of the apparatus according to FIGS. 1 or 3, including additionally the ring rail sensor R and associated logic circuit components. According to the circuit of FIG. 5, when the thread is missing, as indicated by the NOT gate 103, and there is no winding, as indicated by the NOT gate 110, a signal is fed, via the AND gate 120 and an AND gate 124 to the auxiliary thread launching mechanism H only in case that, in addition to the pulse (ONE signal) coming from the AND gate 120, there is also present at the AND gate 124 a pulse (ONE signal) coming from the ring rail sensor R which signals the position of the ring rail as being in its lower region.

A pulse (ONE signal) generated by the ring rail sensor R signaling the fact that the ring rail has some other position is fed through a NOT gate 126 to an AND gate 127 and, if the inputs of this AND gate 127 also get a pulse (ONE signal) coming from the AND gate 120, then a signal is fed through the OR gate 100 to the transport mechanism V to cause its further progress, the reattachment carriage proceeding in that case without having carried out a thread reattachment routine. The remaining components of FIG. 5 need not be described in detail at this point, because they correspond and function as do the components having the same reference letters and numerals in FIGS. 1 and 3.

FIGS. 6–9 show a particularly advantageous embodimental form of a thread transport mechanism as a part of the auxiliary thread lauching device H. In FIGS. 6–9, the thread transport mechanism in its entirety is designated 1 which preferably serves for being installed at reattachment apparatuses for relieving thread breakages in ring-spinning machines. However, it can also be used in cases where the end of a thread is to be thrown onto a spool.

The thread transport mechanism 1 includes a thread-blowing nozzle embodied as an injection nozzle 2 having a connector nipple 5 for compressed air and it is slidably disposed in guides 4 of a slidable device 3. The injection nozzle 2 is fixedly connected with a gliding element 6 which may glide in the guide 4 of the slidable device 3 which can be, for example, a dovetail guide, as shown best in FIG. 7. The gliding element 6 is connected to a pulling member 12, which may be a rope or a chain or the like, and is guided by a reversing roller 13, fastened at the front end of the slidable device 3 behind a mouthpiece 18 of the injection nozzle 2 and is fixedly connected to a locally fixed support 10. A tensile spring 11, fastened at the rear end of the injection nozzle 2, holds this nozzle in a pulled back position. A thread E (FIG. 6) is pulled from a supply bobbin 20 through a thread arrester 21 and through the mouthpiece 18 of the injection nozzle 2. The front end of the slidable device 3 has a thread separator mechanism 15, having two pivotal knives 16 so disposed that, when the slidable device 3 in the injection nozzle 2 is pulled back, the edges of blades 16 touch or press against one another under the compression of a respective spring 22, one for each blade.

The slidable device 3 may be move back and forth on two rods 19 and is provided with gear teeth 7 which mesh with the teeth of a gear 8 rotatably mounted on a drive shaft 9 in the locally fixed support 10. The thread transport mechanism 1 is disposed in the reattachment carriage, before a spinning bobbin or spool 25, and moves parallel thereto. The mechanism 1 is moved up and down, with respect to the bobbin or spool 25, in such a manner that it is always opposite the wind-up region on the spinning bobbin or spool. The routine of operation of the thread transport mechanism 1 according to the present invention is to be described in more detail below.

When a thread is to be thrown onto the bobbin or spool 25, the rotation of the shaft 9 turns the gear 8 acting on the gear teeth 7 of the slidable device 3 so that the latter moves in the direction of the arrow B (FIG. 9) toward the bobbin or spool 25. During this motion and due to the effect of the pulling member 12, the injection nozzle 2, in its guide in the slidable device 3, is moved by twice the path of this slidable member. Its mouthpiece 18 is pushed between the cutting blades 16 and forces them apart so that the thread E is not cut by the blades 16. Subsequently, a compressed air blast P is admitted through the nipple 5, due to which the injection nozzle 2 blows the thread E onto the bobbin or spool 25. The thread E is grasped by the rotating bobbin or spool 25 and is wound up thereon, the thread arrester 21 providing the necessary thread tension which is required for achieving a solid winding.

After a predetermined time, which may be adjusted by a timer (not shown), but which is sufficiently long so that a length of thread sufficient for at least one attachment step has been wound up, the shaft 9 is turned backward and thus the injection nozzle 2 is pulled back by the spring 11. This liberates the cutting blades 16 whose edges are pressed against one another due to the action of the spring 22, whereupon the thread E is pinched or cut. When slidable device 3 is pulled back, the bobbin or spool 25 continues to rotate and breaks the thread E between the cutting blades 16 and the bobbin or spool 25 in the event the blades themselves did not effect a cutting, but only pinch the thread.

At this time, the automatic thread reattachment routine for repairing the thread breakage, including the search step is initiated. The free end of the thread obtained by the thread separator mechanism 15, and located on the bobbin or spool 25, is searched for by the search mechanism S, as was described in the text relating to FIGS. 1 to 5 and the end of the thread is pulled into the traveler and the thread guide by the attachment apparatus A and is finally combined with the roving emerging from the delivery rollers.

It is to be appreciated that the foregoing description and accompanying drawing relate to embodiments given by way of example, not by way of limitation. Numerous other embodiments and variants are possible within the spirit and scope of the invention, the scope being defined by the appended claims.

What is claimed is:

1. In a method for the automatic repair of thread breakage in spinning machines which includes searching for an end of a broken thread on a take-up thread holder as a preliminary step, grasping the end of the thread if found, pulling the thus grasped thread into a traveler and a thread guide and combining the thus pulled thread with roving emerging from delivery rollers, the improvement comprising determining if repair of thread breakage is not possible by the foregoing series of steps, then automatically supplying an auxiliary thread from an auxiliary thread supply and fastening it on the thread holder, subsequently detaching the auxiliary thread from its supply thereby providing a new thread end on the thread holder, and thereafter performing the searching, grasping, pulling and combining steps of the method.

2. An improved method according to claim 1, wherein at first the searching step to find the broken thread end is initiated and, if this step is without result, then the fastening of the auxiliary thread on the thread holder is initiated.

3. An improved method according to claim 1, wherein prior to initiating the searching step to find the end of the broken thread, determining whether a thread winding is present on the thread holder and, if a winding is present on the thread holder, then initiating the searching step to find the end of the broken thread and, if a winding is not present on the thread holder, then initiating the fastening of the thread on the thread holder.

4. In an apparatus for the automatic repair thread breakage in spinning machines, which apparatus includes means for sensing a broken thread, means for searching for an end of a broken thread on a take-up thread holder, said means for searching being actuatable by said means for sensing, means for reattaching the thread which include means for pulling the thread into a traveler and a thread guide, and means for combining the thread with roving emerging from delivery rollers, the improvement comprising: means, responsive to output from said means for searching, for actuating said means for attaching whenever an end of a broken thread is located; and means, responsive to output from said means for searching, for supplying and fastening an auxiliary thread on said thread holder whenever an end of a broken thread is not located.

5. An improved apparatus according to claim 4, wherein said means for supplying and fastening an auxiliary thread includes a movable auxiliary thread supply, a transport means for taking a thread from said auxiliary thread supply and guiding it to said thread holder to permit a certain minimum length to be wound up thereon, and separator means for separating the thus wound up thread from said movable auxiliary thread supply, whereupon the means for searching is actuated anew.

6. An improved apparatus according to claim 5, further comprising means sensing the presence or absence of a thread winding on the thread holder, which include: control means for allowing said actuation of the means for searching by the means for sensing in the presence of said thread winding, and for not allowing said actuation of the means for searching by the means for sensing in the absence of said thread winding; and means for actuating said means for supplying and fastening an auxiliary thread, in the absence of said thread winding.

7. An improved apparatus according to claim 4, further comprising means sensing the presence or absence of a thread winding on the thread holder which include: control means for allowing said actuation of the means for searching by the means for sensing in the presence of said thread winding, and for not allowing said actuation of the means for searching by the means for sensing in the absence of said thread winding; and means for actuating said means for supplying and fastening an auxiliary thread, in the absence of said thread winding.

8. An improved apparatus according to claim 7, further comprising: means for determining if an exchange of a full thread holder for an empty thread holder has taken place, and means actuatable immediately after said exchange of thread holders before restart of a winding routine to fill the empty thread holder, which includes means for disabling said means sensing presence or absence of a thread winding, means for preventing said actuation of the means for searching by the means for sensing, and means for initiating actuation of said means for reattaching the thread.

9. An improved apparatus for the automatic repair of thread breakage in spinning machines, as described in claim 4, wherein said means for supplying and fastening an auxiliary thread includes:

- a movable auxiliary thread supply;
- a locally fixed support member;
- a locally fixed guide member;
- a slidable device mounted slidably on said guide member between an advanced and a pulled back position; having a front end positioned in the vicinity of the thread holder and surfaces defining a guide disposed parallel to said fixed guide member;
- a thread injection nozzle for transporting the auxiliary thread from said auxiliary thread supply to said thread holder which is slidably mounted in said guide of said slidable member, and which includes:
- a thread inlet at a back end;
- a thread outlet at a front end, and
- a connector nipple for a pressure medium;
- a tensile spring fastened at the back end of said nozzle for holding said nozzle in a pulled-back position;
- a reversing roller located at one end of said slidable device;
- a tensile member guided around said reversing roller, which has one end fastened to said nozzle and an opposite end fastened to said locally fixed support member, whereby sliding movement of said slidable device in one direction produces a sliding movement of said nozzle in the same direction; and two separator blades pivotably fastened to the front of said slidable device, whose edges are pressed against one another under spring compression, said blades being pushed apart by said nozzle when said nozzle is pushed forward and said blades being capable of holding or separating the auxiliary thread passing between them when said nozzle is pulled back.

10. A method for the automatic repair of a thread breakage in spinning machines, which comprises the steps of:

sensing a broken thread;

sensing an exchange of a full thread holder for an empty thread holder;

when a broken thread is sensed immediately upon restarting a winding routine after the exchange of a full thread holder for an empty thread holder, initiating the sequential steps of supplying an auxiliary thread from an auxiliary thread supply, fastening the auxiliary thread on the thread holder, and then detaching the auxiliary thread from its supply to provide a new thread end on the thread holder;

when a broken thread is sensed at any other time during the winding routine other than immediately upon restarting the winding routine after said exchange of thread holders, sensing the presence of a thread winding on the thread holder;

when the presence of a thread winding is not sensed, initiating said steps of supplying, fastening, and detaching the auxiliary thread;

when the presence of a thread winding is sensed, initiating the steps of locating and grasping an end of the broken thread on the thread holder;

when said end of the broken thread is located and grasped, initiating the step of reattaching the grasped end of broken thread by pulling the grasped thread into a traveler and a thread guide and combining the thread thus pulled with roving emerging from delivery rollers;

when said end of the broken thread is not located and grasped, initiating said steps of supplying, fastening, and detaching the auxiliary thread; and when the auxiliary thread has been detached from its supply, initiating said steps of locating and gasping the end of the broken thread on the thread holder.

* * * * *